United States Patent [19]

Applegate et al.

[11] Patent Number: 4,775,252

[45] Date of Patent: Oct. 4, 1988

[54] THERMAL PRINTHEAD ACTUATOR RESPONSIVE TO CARRIAGE DRIVE AND INCLUDING A FOUR BAR LINKAGE AND SPRING

[75] Inventors: Steven L. Applegate; James J. Molloy; Deh C. Tao, all of Lexington, Ky.

[73] Assignee: International Business Machines Corporation, Armonk, N.Y.

[21] Appl. No.: 114,176

[22] Filed: Oct. 28, 1987

[51] Int. Cl.[4] ..... B41J 3/20

[52] U.S. Cl. ..... 400/120; 346/76 R

[58] Field of Search ..... 400/120; 346/76 R

[56] References Cited

U.S. PATENT DOCUMENTS

| | | | |
|---|---|---|---|
| 4,329,075 | 5/1982 | Applegate et al. | 400/120 X |
| 4,439,777 | 3/1984 | Aprato | 400/120 X |
| 4,563,692 | 1/1986 | Negita et al. | 400/120 X |
| 4,609,299 | 9/1986 | Hattori et al. | 400/120 X |
| 4,641,150 | 2/1987 | Matsuura et al. | 400/120 X |
| 4,657,417 | 4/1987 | Kikuchi et al. | 400/120 X |
| 4,707,154 | 11/1987 | Arai | 400/120 X |

FOREIGN PATENT DOCUMENTS

| | | | |
|---|---|---|---|
| 0205176 | 9/1986 | Japan | 400/120 |

*Primary Examiner*—Ernest T. Wright, Jr.

*Attorney, Agent, or Firm*—John J. McArdle, Jr.; Frank C. Leach

[57] ABSTRACT

A thermal printhead, which is pivotally mounted on a carrier, is moved into and out of its printing position by a four bar linkage, which is responsive to the direction in which the carrier is being advanced, rendering a spring, which urges the thermal printhead into its printing position, effective and ineffective. When the carrier is advanced from left to right to print, the linkage responds to a drive mechanism for the carrier to enable movement of the printhead into its printing position by the spring prior to the carrier drive mechanism moving the carrier. When the carrier is to be moved from right to left in the non-printing direction, the linkage responds to the initial motion of the carrier drive mechanism in this direction to render the spring ineffective and to move the printhead out of its printing position prior to the carrier drive mechanism moving the carrier.

20 Claims, 2 Drawing Sheets

THERMAL PRINTHEAD ACTUATOR RESPONSIVE TO CARRIAGE DRIVE AND INCLUDING A FOUR BAR LINKAGE AND SPRING

FIELD OF THE INVENTION

This invention relates to an actuator for moving a thermal printhead into and out of its printing position and, more particularly, to a mechanical actuator for moving the thermal printhead into and out of its printing position in response to actuation of drive means for a carrier on which the thermal printhead is mounted.

BACKGROUND OF THE INVENTION

A printhead of a low impact or non-impact printer such as a thermal printer, and particularly a resistive ribbon printer, must be moved into engagement with a platen prior to beginning print in one direction and must be removed from its printing position prior to returning the printhead to the start of another print line. When the resistive ribbon printhead, which has electrodes for engaging a resistive ribbon to cause printing on a sheet of paper passed around a platen, is in its printing position, its electrodes must engage the resistive ribbon to apply heat thereto when selected electrodes are energized. Therefore, it is necessary for a force to be applied to the printhead in its printing position to hold the electrodes against the resistive ribbon.

U.S. Pat. No. 4,329,075 to Applegate et al, which is incorporated by reference herein, discloses a resistive ribbon printhead being moved into its printing position by activation of a solenoid. This requires the solenoid to be continuously activated when the resistive ribbon printhead is in its printing position. While this arrangement is satisfactory, the solenoid and its energization increase the cost of the printer and the cost of operation.

SUMMARY OF THE INVENTION

The present invention reduces the cost for moving a resistive ribbon printhead into its printing position and retaining it therein by using a mechanical actuator, which is less expensive than a solenoid and has no energization expense. This is accomplished through the actuator having means, which enables movement of the printhead into and out of its printing position, responsive to the initial activation of carrier drive or motive means for advancing a carrier, which has the printhead mounted thereon.

The actuator of the present invention preferably becomes effective before the carrier starts to move in either direction. Thus, the printhead is either in or out of its printing position depending upon its direction of motion before the printhead is moved axially relative to the resistive ribbon, the paper, and the platen.

In one embodiment, the actuator includes a four bar linkage and a spring that becomes effective when the linkage has reached the position in which the carrier motive or drive means begins to drive the carrier with this spring having a sufficient force to hold the electrodes in engagement with the resistive ribbon during printing. This spring does not become effective until after the resistive ribbon printhead is in its printing position.

Because of the linkage, only a very small actuating force is required to maintain a printhead force against the resistive ribbon of at least twice the actuating force. This is because most of the reaction force of the pivots of the linkage of the actuator is in a direction normal to the travel of the carrier.

In another embodiment, the printhead is subjected to a continuous force of a spring holding the printhead against the resistive ribbon. This embodiment requires a much larger driving force than the embodiment in which the spring does not become effective until after the electrodes of the printhead engage the resistive ribbon in its printing position.

An object of this invention is to provide a mechanical actuator for moving a thermal printhead into and out its printing position.

Another object of this invention is to provide a thermal printhead actuator which automatically responds to the initial motion of the carrier motive or drive means in the opposite direction from that in which it was moving.

The foregoing and other objects, features, and advantages of the invention will be apparent from the following more particular description of the preferred embodiments of the invention as illustrated in the accompanying drawings.

DETAILED DESCRIPTION

Figure 1:
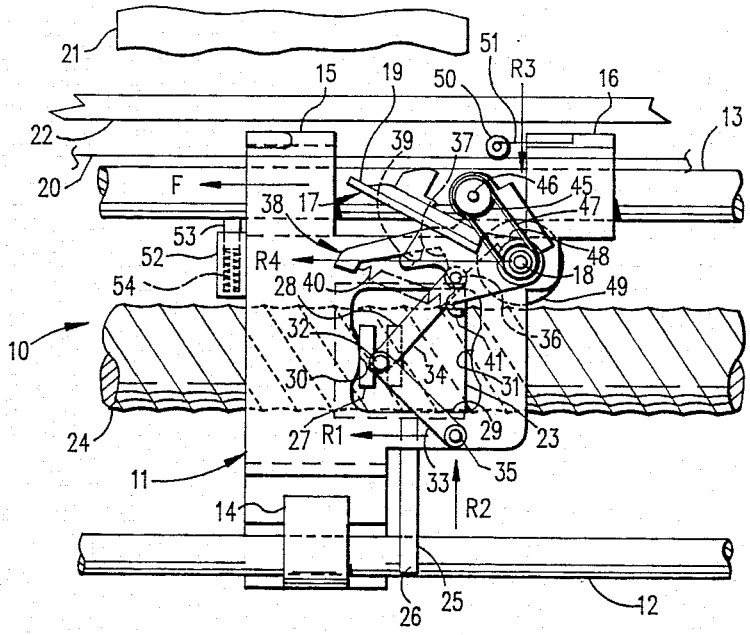
FIG. 1 is a fragmentary top plan schematic view of a portion of a thermal printer including one form of an actuator for a thermal printhead with the printhead in its inoperative position.

Referring to the drawings and particularly FIG. 1, there is shown a thermal printer 10 having a carrier 11 for sliding movement along a pair of substantially parallel rails 12 and 13. The carrier 11 has a shoe 14 sliding along the round rail 12 and bearings 15 and 16 sliding along the round rail 13.

A thermal printhead assembly 17 is pivotally supported on the carrier 11 by a shaft 18, which is rotatably supported by the carrier 11. The thermal printhead assembly 17 includes a thermal printhead 19 having a plurality of electrodes arranged in a single column in the manner more particularly shown and described in the aforesaid Applegate et al patent. When the thermal printhead assembly 17 is pivoted clockwise about the shaft 18 from the position of FIG. 1 to the position of FIG. 2 in which the thermal printhead 19 is in its printing position, the electrodes in the thermal printhead 19 are selectively energized to apply heat to a resistive ribbon 20 to produce printing on a sheet 21 of paper. The sheet 21 of paper is supported on a platen 22.

Figure 2:
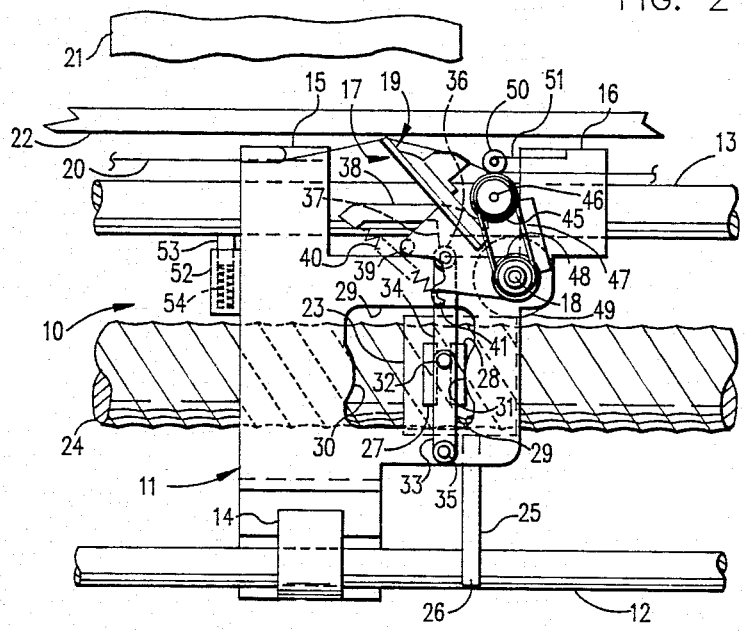
FIG. 2 is a fragmentary top plan schematic view of a portion of the thermal printer of FIG. 1 with the printhead in its printing position.

The thermal printhead 19 is moved from the position of FIG. 1 to the position of FIG. 2 when a nut 23 begins to move from left to right to initiate a print line. The nut 23 is moved by rotation of a leadscrew 24, which is driven from suitable driving means (not shown) in the well-known manner.

The rotary motion of the leadscrew 24 is changed into linear motion of the carrier 11 through the nut 23, which has a guide 25 extending therefrom with bifurcated ends 26 disposed on opposite sides of the round rail 12. Thus, the guide 25 prevents the nut 23 from rotating when the leadscrew 24 is rotated so that the nut 23 moves linearly when the leadscrew 24 rotates. The nut 23 has a pair of spaced and substantially parallel bars 27 and 28 extending upwardly therefrom into an opening 29 in the carrier 11.

When the bar 27 engages a curved projection 30 on the left side of the opening 29 as shown in FIG. 1, clockwise (as viewed from the left end) rotation of the leadscrew 24 causes the carrier 11 to move from right to left. When the bar 28 is engaging a curved projection 31 on the right side of the opening 29 as shown in FIG. 2, counterclockwise (as viewed from the left end) rotation of the leadscrew 24 causes the carrier 11 to move from left to right.

When the carrier 11 and the nut 23 are in the position of FIG. 1 and the leadscrew 24 is rotated counterclockwise (as viewed from the left end), the nut 23 advances from the position of FIG. 1 towards the position of FIG. 2. A pivot pin 32, which pivotally connects one end of a first link 33 to one end of a second link 34, moves horizontally with the horizontal motion of the nut 23 as the pivot pin 32 is retained between the bars 27 and 28.

The first link 33 has its other end pivotally connected to the carrier 11 by a pivot pin 35. The second link 34 has its other end pivotally connected by a pivot pin 36 to a portion 37 of an actuating arm 38.

The actuating arm 38 is pivotally mounted on the shaft 18 so that movement of the nut 23 from left to right from the position of FIG. 1 eventually causes the links 33 and 34 to become vertical and aligned as shown in FIG. 2. As the links 33 and 34 move towards the vertical and aligned position of FIG. 2, the actuating arm 38 pivots clockwise about the shaft 18.

In the position of FIG. 1, a pin 39 on the thermal printhead assembly 17 engages the actuating arm 38. This prevents a tension spring 40, which extends between the actuating arm 38 and a hook 41 on the thermal printhead assembly 17, from being effective. Thus, in the position of FIG. 1, the tension spring 40 has no effect on the actuating arm 38.

As the nut 23 moves to the right from the position of FIG. 1 to FIG. 2, the actuating arm 38 pivots clockwise about the shaft 18. The tension spring 40 causes the thermal printhead assembly 17 to follow this pivoting of the actuating arm 38 until the thermal printhead 19 engages the platen 22 through the ribbon 20 and the sheet 21 of paper. When this occurs, further pivoting of the thermal printhead assembly 17 about the shaft 18 is prevented. Since the nut 23 has not engaged the curved projection 31 of the opening 29, the actuating arm 38 continues to pivot clockwise about the shaft 18 as the links 33 and 34 move towards the vertical and aligned position of FIG. 2. This stretches the spring 40, creating the necessary force of the thermal printhead 19 against the platen 22. There is no horizontal actuating force required to keep the thermal printhead 19 in its printing position of FIG. 2.

Figure 3:
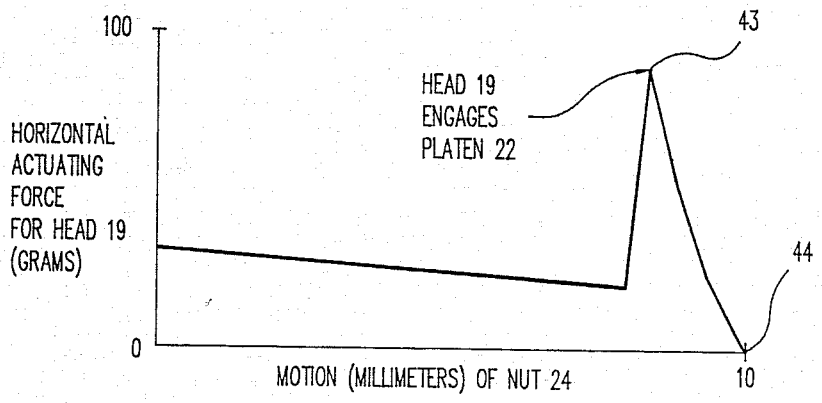
FIG. 3 is a graph showing the relationship of the horizontal actuating force applied to the printhead with respect to the distance traveled by a driving nut.

The stretching of the spring 40 is shown in FIG. 3 between points 43 and 44. At the point 43, the thermal printhead 19 (see FIG. 2) has moved the resistive ribbon 20 against the sheet 21 of paper and the platen 22. At the point 44 in FIG. 3, the links 33 and 34 are vertical and aligned as shown in FIG. 2. In this position, the linkage is locked in place, and there is no horizontal actuating force required to keep the thermal printhead 19 in its printing position.

When the links 33 snd 34 are vertical and aligned as shown in FIG. 2, the bar 28 on the nut 23 is engaging the curved projection 31 on the right side of the opening 29. This results in the carrier 11 being advanced from left to right by the leadscrew 24 rotating counterclockwise (as viewed from the left end).

The actuating arm 38 has a metering roller 45 rotatably supported thereon through a shaft 46. A timing belt 47 connects the metering roller 45 to a roller 48, which is fixed to the shaft 18 for rotation therewith.

The shaft 18 is rotated by a drive roller 49, which is secured to the shaft 18, rotating along the rail 13 as the carrier 11 is advanced from left to right. Since the metering roller 45 engages the ribbon 20 and holds it against a metering roller 50, which is supported on the bearing 16 by a leaf spring 51, the motion of the carrier 11 from left to right causes the ribbon 20 to be advanced from right to left by the rotation of the metering roller 45 in cooperation with the metering roller 50.

When the carrier 11 has completed its movement from left to right, printing stops. The direction of rotation of the leadscrew 24 is reversed so that the nut 23 will be advanced right to left from the position of FIG. 2 to the position of FIG. 1.

The initial rotation of the leadscrew 24 causes only the nut 23 to move to the left, not the carrier 11. This right to left motion of the nut 23 moves the pivot pin 32 therewith to break the alignment of the links 33 and 34. This initially causes the actuating arm 38 to pivot counterclockwise about the shaft 18 to withdraw the metering roller 45 from engagement with the metering roller 50.

When the actuating arm 38 engages the pin 39 on the thermal printhead assembly 17 during continued counterclockwise pivoting of the actuating arm 38, the thermal printhead 19 is withdrawn from the printing position of FIG. 2 in which the resistive ribbon 20 is held against the sheet 21 of paper and the platen 22. The engagement of the actuating arm 38 with the pin 39 on the thermal printhead assembly 17 causes the thermal printhead assembly 17 to follow the pivotal motion of the actuating arm 38 by also pivoting counterclockwise about the shaft 18. This causes the tension spring 40 to no longer be effective.

When the nut 23 reaches the position of FIG. 1, the bar 27 engages the curved projection 30 on the left side of the opening 29. This engagement causes the carrier 11 to begin to move from right to left.

The carrier 11 has a plunger housing 52 in which a plunger 53 is slidably supported. A spring 54 within the plunger housing 52 continuously urges the plunger 53 against the rail 13. The force of the spring 54 is selected so that the force produced by the total friction between the carrier 11 and the rails 12 and 13 exceeds the force required to move the thermal printhead 19 from the position of FIG. 1 to its printing position of FIG. 2. Otherwise, the carrier 11 would begin to move before completion of motion of the thermal printhead 19 to its printing position of FIG. 2 from the position of FIG. 1.

This is a four bar linkage arrangement in which the four pivots are the pivot pins 32, 35, and 36, and the shaft 18. The four links are the first link 33, the second link 34, the portion of the actuating arm 38 between the pivot pin 36 and the shaft 18, and the portion of the carrier 11 between the shaft 18 and the pivot pin 35.

In FIG. 1, R1 is the horizontal component of the reaction force from the carrier 11 on the pivot pin 35 when the links 33 and 34 are moved towards the vertical alignment of FIG. 2, and R2 is the vertical component of the reaction force from the carrier 11 on the pivot pin 35 when the links 33 and 34 are moved towards the vertical alignment of FIG. 2. The vertical component of the reaction force from the carrier 11 at the shaft 18 is R3 while R4 is the horizontal component of the reaction force from the carrier 11 at the shaft 18; these are when the links 33 and 34 are moved towards the vertical alignment of FIG. 2.

The magnitudes of R1 (see FIG. 1) and R2 are determined in part by the angle of the link 33 to the vertical at any time. The angle of the link 34 determines in part the magnitudes of R3 and R4. It is desired to increase R2 and R3 while minimizing R1 and R4, and this occurs when the angles of the links 33 and 34 to the vertical are close to zero.

Minimizing the magnitudes of R1 and R4 is important because the required force to actuate the thermal printhead 19 equals the sum of R1 and R4. The lower this sum of R1 and R4, the less frictional drag is required of the plunger 53 and the less power is required to move the carrier 11.

Figure 4:
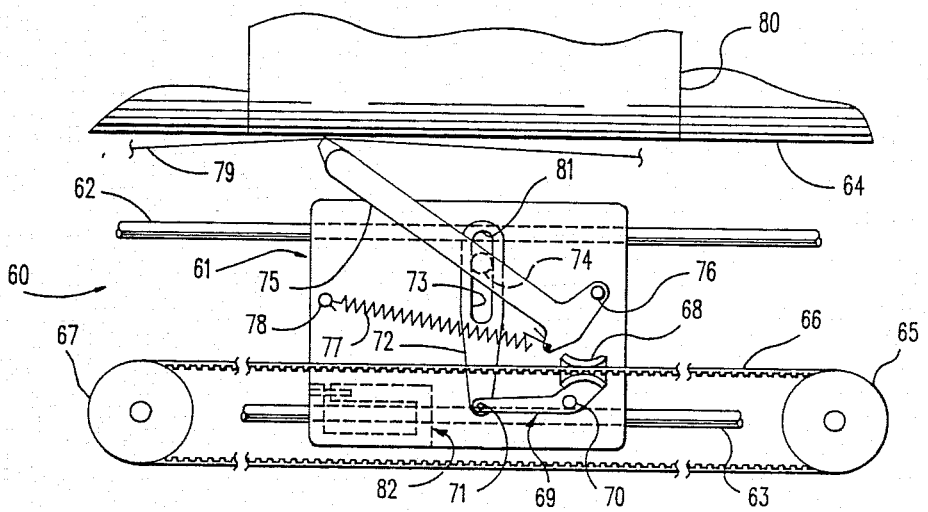
FIG. 4 is a fragmentary top plan schematic view of a portion of a thermal printer including another embodiment of an actuator for a thermal printhead with the printhead in its printing position.
Figure 5:
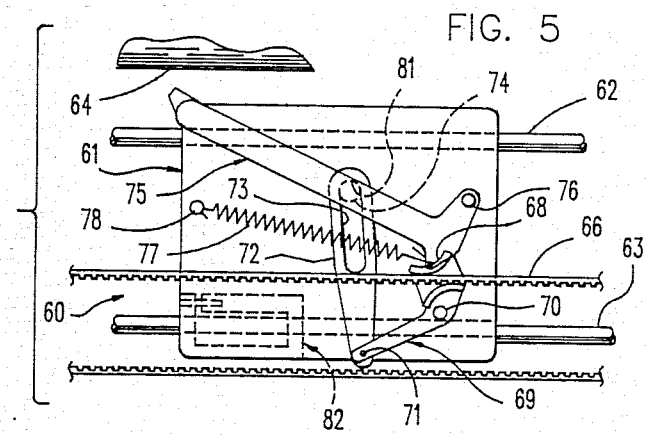
FIG. 5 is a fragmentary top plan schematic view of a portion of the thermal printer of FIG. 4 with the printhead in its inoperative position.

Referring to FIGS. 4 and 5, there is shown a thermal printer 60 including a carrier 61, which is slidably mounted on round rails 62 and 63 for linear motion relative to a platen 64. The carrier 61 has shoes (not shown) or the like for slidably mounting the carrier 61 on the rails 62 and 63.

The carrier 61 is driven in opposite directions from a drive roller 65, which is rotated by suitable drive means (not shown). The drive roller 65 drives a timing belt 66, which also passes around an idler roller 67, in the direction in which it is desired for the carrier 61 to move. Printing occurs when the carrier 61 moves from left to right in FIGS. 4 and 5.

A portion of the timing belt 66 is fixed to a clamp 68 on one end of a first link 69, which is pivotally mounted on the carrier 61 by a pivot pin 70. Thus, when the drive roller 65 rotates clockwise to advance the carrier 61 from left to right, the first link 69 pivots clockwise about the pivot pin 70.

The first link 69 has its other end pivotally connected by a pivot pin 71 to one end of a second link 72, which has a slot 73 therein to receive a pin 74 on a thermal printhead 75. The end of the thermal printhead 75 would have electrodes arranged in a single column in the same manner as shown and described in the aforesaid Applegate et al patent, for example.

The thermal printhead 75 is pivotally mounted on the carrier 61 by a pivot pin 76. A spring 77, which has one end fixed to a stud 78 extending upwardly from the carrier 61 and its other end attached to the thermal printhead 75, continuously urges the thermal printhead 75 clockwise about the pivot pin 76 to its printing position. In its printing position, the thermal printhead 75 holds a resistive ribbon 79 against a sheet 80 of paper on the platen 64.

When the drive roller 65 is rotated clockwise after having been previously rotated counterclockwise, the first link 69 pivots clockwise about the pivot pin 70 to raise the second link 72 upwardly. This removes a curved upper end 81 of the slot 73 in the second link 72 from engagement with the pin 74 on the thermal printhead 75, as shown in FIG. 5, so that the thermal printhead 75 can be biased by the spring 77 to its printing position of FIG. 4.

When the drive roller 65 is rotated counterclockwise to move the carrier 61 from right to left when no printing occurs, the motion of the timing belt 66 causes counterclockwise pivoting of the first link 69 about the pivot pin 70. This pulls the second link 72 downwardly whereby the curved upper end 81 of the slot 73 in the link 72 engages the pin 74 on the thermal printhead 75 to move the thermal printhead 75 against the force of the spring 77 and away from its printing position. This occurs at the start of the return of the carrier 61 from right to left.

Figure 6:
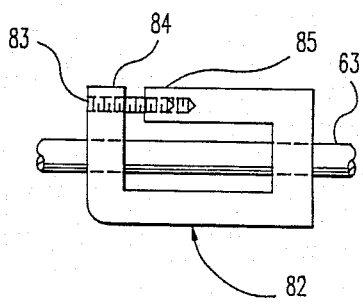
FIG. 6 is an enlarged plan view of a portion of the thermal printer of FIG. 4 to show the arrangement for controlling the force required to move the carrier.

To insure that there is sufficient friction between the carrier 61 ahd the rails 62 and 63 so that the carrier 61 does not begin to move until the thermal printhead 75 is either in its printing position if the motion of the carrier 61 is to be from left to right or is out of its printing position if the motion of the carrier 61 is to be from right to left, the carrier 61 has a portion 82, which is formed of a suitable plastic such as an acetal resin sold as Delrin, for example, riding on the rail 63. An Allen screw 83 (see FIG. 6) connects an end 84 of the portion 82 of the carrier 61 (see FIG. 5) to an end 85 (see FIG. 6) of the portion 82 of the carrier 61 (see FIG. 5). The spacing between the ends 84 (see FIG. 6) and 85 of the portion 82 of the carrier 61 (see FIG. 5) determines the friction between the carrier 61 and the rail 63 so that the force created by the total friction between the carrier 61 and the rails 62 and 63 is greater than the force required to move the thermal printhead 75 into or out of its printing position. Otherwise, the carrier 61 would move before the thermal printhead 75 is in or out of its printing position.

The thermal printer 60 has a four bar linkage in the same manner as the thermal printer 10 (see FIG. 1). The four pivot connections are the pivot pins 70 (see FIG. 4), 71, and 76 and the pin 74. The four links are the first link 69, the second link 72, the portion of the thermal printhead 75 between the pin 74 and the pivot pin 76, and the portion of the carrier 61 between the pivot pins 70 and 76.

While each of the thermal printheads 19 (see FIG. 1) and 75 (see FIG. 4) has been shown as being pivotally mounted, it should be understood that such is not a requisite for satisfactory operation. That is, the thermal printhead 19 (see FIG. 1) or 75 (see FIG. 4) could be mounted on the carrier 11 (see FIG. 1) or 61 (see FIG. 4) for linear movement, for example.

In the preferred embodiments, the inertia of the forces on the carrier 11 (see FIG. 1) or 61 (see FIG. 4) is insufficient to overcome the frictional forces after the nut 23 (see FIG. 1) or the drive roller 65 (see FIG. 4) is stopped. Thus, there is no motion of the carrier 11 (see FIG. 1) away from the nut 23 after the nut 23 is stopped or of the carrier 61 (see FIG. 4) relative to the drive roller 65 after the drive roller 65 is stopped.

An advantage of this invention is that it decreases the cost of a thermal printer. Another advantage of this invention is that it eliminates the requirement for an electromechanical actuator for moving a thermal printhead into and out of its printing position.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A thermal printer including:

a thermal printhead;

a carrier supporting said thermal printhead for movement therewith;

printhead mounting means for mounting said thermal printhead on said carrier for movement into and out of its printing position;

support means for slidably supporting said carrier for bidirectional movement;

carrier moving means for moving said carrier along said support means in opposite directions to produce the bidirectional movement of said carrier;

printhead moving means for moving said thermal printhead into and out of its printing position;

said thermal printhead being movable into its printing position by said printhead moving means when said carrier is moved in one of its opposite directions along said support means;

and said printhead moving means including means responsive to activation of said carrier moving means when said carrier moving means is to move said carrier in the one direction to move said thermal printhead into its printing position, if the thermal printhead is not in its printing position, before said carrier moving means starts to move said carrier in the one direction and responsive to activation of said carrier moving means when said carrier moving means is to move said carrier in the other of its opposite directions to move said thermal printhead out of its printing position, if the thermal printhead is not out of its printing position, before said carrier moving means starts to move said carrier in the other direction.

2. The thermal printer according to claim 1 in which said responsive means of said printhead moving means includes:

first means attached to said carrier moving means for movement therewith;

and transmitting means connected to said first means for transmitting movement of said first means to enable movement of said thermal printhead into its printing position when said carrier moving means is activated to move said carrier in the one direction and to enable movement of said thermal printhead out of its printing position when said carrier moving means is activated to move said carrier in the other direction.

3. The thermal printer according to claim 2 in which said printhead mounting means includes means to pivotally mount said thermal printhead on said carrier for pivotal movement into and out of its printing position.

4. The thermal printer according to claim 3 in which said transmitting means includes linkage means.

5. The thermal printer according to claim 4 in which said linkage means is a four bar linkage.

6. The thermal printer according to claim 5 in which said four bar linkage includes:

a first link having one end pivotally connected to said carrier;

means connecting the other end of said first link to said first means of said responsive means of said printhead moving means;

a second link having one of its ends pivotally connected to the other end of said first link and to said first means of said responsive means of said printhead moving means;

and means pivotally connected to the other end of said second link and to said carrier to enable movement of said thermal printhead into its printing position when said carrier moving means is activated to move said carrier in the one direction and to enable movement of said thermal printhead out of its printing position when said carrier moving means is activated to move said carrier in the other direction, said pivotally connected means being pivotally connected to said carrier on the same pivot axis as said pivotal mounting means of said printhead mounting means.

7. The thermal printer according to claim 6 in which:

said carrier moving means includes rotating means;

said first means of said responsive means of said printhead moving means includes conversion means mounted on said rotating means to convert rotary motion of said rotating means to axial motion of said carrier;

and said connecting means of said four bar linkage connecting the other end of said first link to said first means of said responsive means of said printhead moving means includes means for connecting the other end of said first link to said conversion means.

8. The thermal printer according to claim 5 in which said four bar linkage includes:

a first link pivotally connected to said carrier intermediate its ends;

means connecting one of the ends of said first link to said carrier moving means;

a second link having one of its ends pivotally connected to the other end of said first link;

and means pivotally connecting said second link and said thermal printhead to enable movement of said thermal printhead into its printing position when said carrier moving means is activated to move said carrier in the one direction and to enable movement of said thermal printhead out of its printing position when said carrier moving means is activated to move said carrier in the other direction.

9. The thermal printer according to claim 8 in which:

said carrier moving means includes axial moving means;

said first means of said responsive means includes one end of said first link fixed to said axial moving means;

and said pivotally connecting means of said four bar linkage pivotally connecting said second link and said thermal printhead includes: a pivot pin supported on said printhead; and a slot in said second link to receive said pivot pin.

10. The thermal printer according to claim 2 in which said transmitting means includes linkage means.

11. The thermal printer according to claim 10 in which said linkage means is a four bar linkage.

12. The thermal printer according to claim 1 in which:

said printhead mounting means includes means to pivotally mount said thermal printhead on said carrier for movement into and out of its printing position;

resilient means continuously urges, said thermal printhead to its printing position;

and said responsive means of said printhead moving means includes:

a first link pivotally connected to said carrier, said first link being connected to said carrier moving means;

and linkage means pivotally connected to said first link to enable movement of said thermal printhead into its printing position by said resilient means when said first link is moved by activation of said carrier moving means before said carrier moving means starts movement of said carrier in the one direction, said linkage means moving said thermal printhead out of its printing position when said first link is moved by activation of said carrier moving means before said carrier moving means starts movement of said carrier in the other direction.

13. The thermal printer according to claim 12 in which said linkage means includes:

a second link having one end pivotally connected to an end of said first link;

and means responsive to movement of said second link to enable movement of said thermal printhead.

14. The thermal printer according to claim 13 in which:

said responsive means of said linkage means includes actuating means pivotally connected to the other end of said second link and to said carrier, said actuating means being pivotally connected to said carrier on the same pivot axis as said pivotal mounting means;

and said resilient means is connected to said actuating means and said thermal printhead.

15. The thermal printer according to claim 13 in which:

said resilient means is connected to said thermal printhead and said carrier;

and said responsive means of said linkage means includes:

a pin extending from said thermal printhead;

and said second link having a longitudinal slot to receive said pin to enable movement of said thermal printhead to its printing position by said resilient means when said second link is moved by movement of said first link.

16. The thermal printer according to claim 13 including means to pivotally connect the one end of said first link to said carrier moving means and to the one end of said second link.

17. The thermal printer according to claim 12 including:

means to pivotally connect one end of said first link to said carrier moving means and to said linkage means;

and means to pivotally connect the other end of said first link to said carrier.

18. The thermal printer according to claim 1 in which:

said printhead mounting means includes means to pivotally mount said thermal printhead on said carrier for movement into and out of its printing position;

resilient means continuously urges said thermal printhead to its printing position;

and said responsive means of said printhead moving means includes enabling means for enabling movement of said thermal printhead into its printing position by said resilient means when said enabling means is moved by activation of said carrier moving means before said carrier moving means starts movement of said carrier in the one direction, said enabling means moving said thermal printhead out of its printing position when said enabling means is moved by activation of said carrier moving means before said carrier moving means starts movement of said carrier in the other direction.

19. A thermal printer including:

a thermal printhead;

a carrier supporting said thermal printhead for movement therewith;

printhead mounting means for mounting said thermal printhead on said carrier for movement into and out of its printing position;

support means for slidably supporting said carrier for bidirectional movement;

carrier moving means for moving said carrier along said support means in opposite directions to produce the bidirectional movement of said carrier;

printhead moving means for moving said thermal printhead into and out of its printing position;

said thermal printhead being movable into its printing position by said printhead moving means when said carrier is moved in one of its opposite directions along said support means;

and said printhead moving means including movable means mechanically driven by said carrier moving means when said carrier moving means is to move said carrier in the one direction to move said thermal printhead into its printing position, if the thermal printhead is not in its printing position, and said movable means being mechanically driven by said carrier moving means when said carrier moving means is to move said carrier in the other of its opposite directions to move said thermal printhead out of its printing position, if the thermal printhead is not out of its printing position.

20. The thermal printer according to claim 19 in which said printhead mounting means includes means to pivotally mount said thermal printhead on said carrier for pivotal movement into and out of its printing position.

* * * * *